United States Patent [19]

de Jong et al.

[11] Patent Number: 4,824,599

[45] Date of Patent: Apr. 25, 1989

[54] ENZYMATIC DETERGENT COMPOSITION

[75] Inventors: Hendrik E. de Jong, Rozenburg; Ton Swarthoff, Hellevoetsluis; Johan Haverkamp, Bergschenhoek, all of Netherlands

[73] Assignee: Lever Brothers Company, New York, N.Y.

[21] Appl. No.: 128,302

[22] Filed: Dec. 3, 1987

[30] Foreign Application Priority Data

Dec. 10, 1986 [GB] United Kingdom ..... 8629536

[51] Int. Cl.[4] ..... C11D 3/386; C11D 7/42

[52] U.S. Cl. ..... 252/174.12; 252/DIG. 12

[58] Field of Search ..... 252/174.12, DIG. 12; 435/263, 264

[56] References Cited

U.S. PATENT DOCUMENTS 4,011,169 3/1977 Diehl et al. ..... 252/545
4,480,037 10/1984 Ichishima et al. ..... 435/221

FOREIGN PATENT DOCUMENTS 130064 1/1985 European Pat. Off. .
206390 12/1986 European Pat. Off. .
205208 12/1986 European Pat. Off. .
214761 3/1987 European Pat. Off. .
1930636 1/1985 Fed. Rep. of Germany .
1767413 12/1986 Fed. Rep. of Germany .

OTHER PUBLICATIONS

Lipase, The Enzyme for Detergent, Amano Pharmaceutical Co., Ltd., pre-Jun. 1985.

*Primary Examiner*—A. Lionel Clingman
*Assistant Examiner*—Hoa Van Le
*Attorney, Agent, or Firm*—Milton L. Honig

[57] ABSTRACT

The inclusion of proteases with an isoelectric point of less than 10.0 in a detergent composition which comprises a certain, immunologically defined, class of lipases causes a significantly reduced effect of proteases on lipases in comparison with other proteases. The overall performance of the lipase-containing detergent compositions is substantially less affected by these proteases with a pI of less than 10.0.

4 Claims, No Drawings

ENZYMATIC DETERGENT COMPOSITION

The present invention relates to an enzymatic detergent composition which comprises a special class of lipases and a special class of proteases.

In our co-pending UK patent application No. 8514707 we have described detergent compositions with a special class of lipases. In that patent application we have also described how these lipases rapidly lose activity in the presence of proteases in clean model systems, but that under practical wash conditions in washing machines a substantial benefit is still delivered by these lipases in the presence of proteases.

We have now found that with the use of a particular class of proteases an improved overall performance is obtained with these lipase-containing detergent compositions, the lipolytic activity being substantially less affected by these proteases than by other proteases. This particular class of proteases consists of proteases having an isoelectric point of lower than 10.0, preferably lower than about 9. Such proteases are known in the art and typical examples thereof are Alcalase (ex Novo Industri), Maxatase (ex Gist Brocades), Optimase (ex Miles-Kali Chemie) and Kazusase (ex Showa Denka) (=API-21=AP-1), Subtilisin BPN' ex *B. amyloliquefaciens* (ATCC 23844).

Kazusase is the preferred protease of the present invention; it has been described in the published Dutch patent application No. 8302790 of Showa Denka. Its isoelectric point is 7.4 according to this patent application. The isoelectric points of the other above-mentioned commercially available proteases all lie in the range of 8.7–9.4.

Mixtures of proteases according to the present invention may also be used:

In general, the amount of protease in the detergent composition will be from 0.1–5.0 GU/mg, usually 0.2–40 and preferably 0.5–30 GU/mg, based on the final detergent composition. A GU (glycine unit) is the amount of enzyme which under standard incubation conditions produces an amount of terminal $NH_2$-groups equivalent to 1 microgramme/ml of glycine.

The class of lipases used in the present invention embraces those lipases which show a positive immunological cross-reaction with the antibody of the lipase, produced by the microorganism *Chromobacter viscosum* var. lipolyticum NRRL B-3673. This lipase has been described in Dutch patent specification No. 154,269 of Toyo Jozo KK, and the microorganism is available to the public at the U.S. Department of Agriculture, Agricultural Research Service, Northern Utilization and Development Division, Peoria, Ill. under No. NRRL B-3673. This lipase will be referred to as the "Toyo Jozo" lipase.

The lipases of the present invention should show a positive immunological cross-reaction with the Toyo Jozo lipase antibody, using the standard and well-known immunodiffusion procedure according to Ouchterlony (Acta. Med. Scan., 133, pages 76–79 (1950)).

The preparation of the antiserum is carried out as follows:

Equal volumes of 0.1 mg/ml antigen and of Freund's adjuvant (complete or incomplete) are mixed until an emulsions is obtained. Two female rabbits are injected with 2 ml samples of the emulsion according to the following scheme:

day 0: antigen in complete Freund's adjuvant day 4: antigen in complete Freund's adjuvant day 32: antigen in incomplete Fruend's adjuvant day 60: booster of antigen in incomplete Freund's adjuvant The serum containing the required antibody is prepared by centrifugation of clotted blood, taken on day 67.

The titre of the anti-Toyo Jozo-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All lipases showing a positive immunological cross-reaction with the Toyo Jozo-lipase antibody as hereabove described are lipases according to the present invention. Typical examples thereof are the lipase ex *Pseudomonas fluorescens* IAM 1057 (available under the trade name Amano-P lipase), the lipase ex *Pseudomonas fragi* FERM P 1339 (available under the trade name Amano-B), lipase ex *Pseudomonas nitroreducens* var. lipolyticum FERM P-1338, the lipase ex Pseudomonas sp., available under the trade name Amano-CES, lipases ex *Pseudomonas cepacia,* lipases ex *Chromobacter viscosum,* e.g., *Chromobacter viscosum* var. lipolyticum NRRL B-3673, commercially available from Toyo Jozo Co., Tagata, Japan; and further *Chromobacter viscosum* lipases from US Biochemical Corp., USA and Diosynth Co., The Netherlands, and lipases ex *Pseudomonas gladioli.*

The lipases of the present invention are included in the detergent and bleaching composition in such an amount that the final composition has a lipolytic enzyme activity of from 100 to 0.005 LU/mg, preferably 25 to 0.05 LU/mg of the composition.

A Lipase Unit (LU) is that amount of lipase which produces a 1 μmol of titratable fatty acid per minute in a pH stat. under the following conditions: temperature 30° C.; pH=9.0; substrate is an emulsion of 3.3 wt.% of olive oil and 3.3% gum arabic, in the presence of 13 mmol/l $Ca^{2+}$ and 20 mmol/l NaCl in 5 mmol/l Tris-buffer.

Naturally, mixtures of the above lipases can be used. The lipases can be used in their impurified form or in a purified form, e.g. purified with the aid of well-known adsorption methods, such as a phenyl sepharose-packed column technique.

The detergent compositions of the present invention furthermore comprise one or more detergent surfactants, such as fatty acid soaps, synthetic anionic, nonionic, cationic, amphoteric and zwitterionic detergent surfactants. These detergent surfactants are well known in the art, and suitable examples are fully described in Schwartz, Perry and Berch, "Surface Active Agents and Detergents", Vol. I (1949) and Vol. II (1958) and in Schick, "Nonionic Surfactants", Vol. I (1967).

In general, the composition contains from 1–50%, usually from 2–30% and preferably from 5–25% by weight of one or more detergent surfactants.

The detergent compositions may furthermore include usual detergent ingredients in the usual amounts. They may be unbuilt or built, and may be of the zero-P type (i.e. not containing phosphorus-containing builders). Thus, the compositions may contain from 1–60%, preferably from 5–30% by weight of one or more organic and/or inorganic builders. Typical examples of such builders are the alkali metal ortho-, pyro- and tri-polyphosphates, alkali metal carbonates, either alone or in admixture with calcite, alkali metal citrates, alkaki metal nitrilotriacetates, carboxymethyloxy succinates, zeolites, polyacetal carboxylates and so on. Furthermore, they may contain from 1-35% of a bleaching agent or a bleaching system comprising a bleaching agent and an activator therefor, such as sodium perborate and tetraacetyl ethylene diamine.

The compositions may furthermore comprise lather boosters, foam depressors, anti-corrosion agents, soil-suspending agents, sequestering agents, anti-soil redeposition agents, perfumes, dyes, stabilising agents for the enzymes and bleaching agents and so on. They may also comprise enzymes other than the lipases and the proteases, such as amylases, oxidases and cellulases.

The compositions of the present invention can be formulated in any desired form, such as powders, bars, pastes, liquids, etc.

The invention will further be illustrated by way of Example.

EXAMPLE 1

Washing experiments were carried out in a Tergotometer under the following conditions:

washing time and temperature: 14 minutes at 40° C.;
three rinses with cold water
detergent composition concentration: 1.2 g/l
water hardness: 16° FH
agitation: 100 rpm
test cloth: cotton, soiled with AS 8/groundnut oil/-milk powder
lipase: lipase ex *Pseudomonas gladioli* or lipase Amano-P or Cepacia lipase at 1 LU/ml
protease: Alcalase at 20 GU/ml

| Detergent composition | % by weight |
|---|---|
| sodium linear dodecylbenzenesulphonate | 13.35 |
| sodium $C_{12}$-$C_{13}$ alcohol (6.5 EO) sulphate | 6.67 |
| sodium carbonate | 54.2 |
| sodium tripolyphosphate | 9.01 |
| sodium silicate | 4.6 |
| sodium hydroxide | 1.66 |
| sodium carboxymethylcellulose | 0.5 |
| Dequest 2006 | 1.9 |
| perfume, dye, water | q.s. |

The reflectance of the test cloths were determined in a Reflectometer at 460 nm with a UV filter in the light pathway, and the residual percentage of fatty material on the test cloths was determined by extracting the dried cloths with petroleum ether, and determining the amount of fatty matter from the weight loss of the test cloth.

The following results were obtained:

| | | *Ps. gladioli* | Amano-P | *Cepacia lipase* | No lipase |
|---|---|---|---|---|---|
| R 460* | + Alcalase | 84.5 | 85.0 | 84.7 | 76.6 |
| | − Alcalase | 83.6 | 83.9 | 83.4 | 75.4 |
| % FM | + Alcalase | 3.69 | 3.69 | 3.75 | 4.84 |
| | − Alcalase | 3.68 | 3.66 | 3.72 | 4.77 |

EXAMPLE 2

The procedure of Example 1 was repeated, using Alcalase, or Kazusase, and, for comparison purposes, Esperase, which is a protease ex Novo Industri having an isoelectric point of above 10.

| | | *Pseudomonas gladioli* | *Cepacia lipase* | No lipase |
|---|---|---|---|---|
| | | Cotton test cloth | | |
| R 460* | No protease | 83.5 | 83.0 | 72.6 |
| | Alcalase | 84.7 | 84.2 | — |
| | Kazusase | 83.9 | 83.4 | — |
| | Esperase | 76.1 | 73.9 | — |
| % FM | No protease | 3.8 | 3.9 | 5.8 |
| | Alcalase | 3.8 | 3.8 | — |
| | Kazusase | 4.1 | 4.2 | — |
| | Esperase | 5.1 | 5.6 | — |
| | | Polyester/cotton test cloth | | |
| R 460* | No protease | 71.0 | 69.6 | 61.6 |
| | Alcalase | 72.3 | 70.4 | — |
| | Kazusase | 71.1 | 70.3 | — |
| | Esperase | 67.1 | 64.5 | — |
| % FM | No protease | 2.9 | 3.2 | 5.5 |
| | Alcalase | 2.9 | 3.5 | — |
| | Kazusase | 3.4 | 3.7 | — |
| | Esperase | 4.3 | 4.9 | — |
| | | Polyester test cloth | | |
| R 460* | No protease | 78.2 | 77.1 | 72.0 |
| | Alcalase | 78.9 | 78.1 | — |
| | Kazusase | 78.3 | 76.8 | — |
| | Esperase | 74.0 | 73.5 | — |
| % FM | No protease | 2.8 | 3.4 | 4.4 |
| | Alcalase | 3.3 | 3.7 | — |
| | Kazusase | 3.6 | 3.9 | — |
| | Esperase | 4.4 | 4.5 | — |

EXAMPLE 3

The performance of Cepacia lipase in the presence of alkaline and high alkaline proteases on test cloths in washing machines with the following detergent formulation was measured:

| | Parts by weight |
|---|---|
| Sodium dodecyl benzene sulphonate | 8.5 |
| $C_{12}$-$C_{15}$ primary alcohol, condensed with 7 moles of ethylene oxide | 4.0 |
| Sodium-hardened rapeseed oil soap | 1.5 |
| Sodium triphosphate | 33.0 |
| Sodium carbonate | 5.0 |
| Sodium silicate | 6.0 |
| Sodium sulphate | 20.0 |
| Water | 9.0 |
| Fluorescers, soil-suspending agents, dyes, perfumes | minor amount |
| Sodium perborate | 12.0 |
| Tetraacetyl ethylene diamine (TAED) (granules) | 2.0 |
| Proteolytic enzyme (Savinase ex NOVO) | 0.4 |

4° wash result of multi-cycle washing (MCSW).

Soiling: Cotton soiled with mixture of inorganic pigments, palm oil (A) and protein (Cocktail I (B)).

Conditions: 5 g/l detergent components; 30 min. at 30° C.; 40° FH; protease: 20 GU/ml; Cepacia lipase: 1 LU/ml; 3.5 kg soiled load present; AS10 as single wash monitor for protease effects.

N: Number of individual MCSW experiments

Esperase HAP Y: pI > 10

Alcalase Kazusase: pI < 10

| Protease | pI | *Cepacia lipase* | Test cloth A AS8/palm oil R460* | % FM | Test cloth B AS8/palm oil/Cocktail I R460* | % FM | AS10 ΔR460* |
|---|---|---|---|---|---|---|---|
| — | | − | 69.0 | 13.5 | 64.8 | 15.6 | 9.4 |
| — | | + | 77.9 | 8.8 | 77.1 | 7.4 | 9.4 |
| Esperase | 10.5 | + | 73.7 | 11.4 | 70.9 | 14.1 | 25.8 |
| HAP A | 10.5 | + | 73.0 | 11.3 | 71.1 | 14.9 | 24.2 |
| Savinase | 10.3 | + | 74.6 | 10.2 | 74.1 | 11.7 | 31.5 |
| Maxacal | 10.3 | + | 74.1 | 11.0 | 71.8 | 13.0 | 31.0 |
| HAP Y | 10.3 | + | 73.4 | 11.5 | 73.3 | 12.2 | 30.5 |
| Alcalase | 9.0 | + | 74.3 | 10.0 | 75.6 | 10.8 | 28.6 |
| Maxatase | 9.0 | + | 75.5 | 9.4 | 76.3 | 10.0 | 29.2 |
| Optimase | 9.0 | + | 74.4 | 11.2 | 74.9 | 11.4 | 28.8 |
| Kazusase | 7.4 | + | 77.5 | 8.3 | 79.5 | 7.8 | 30.7 |

EXAMPLE 4

The preformance of Cepacia lipase in the presence of alkaline and high alkaline proteases on test cloths in washing machines in the detergent composition of Example 3 was measured.

(4° wash results of MCSW)

Monitors Single wash: AS10 (for protease performance); multi wash: cotton test cloths soiled with a mixture of inorganic pigments, groundnut oil, without (A) or with (B) protein (Cocktail I).

Conditions 5 g/l F. Skip; 30 min. at 30° C.; 27° FH; protease: 20 GU/ml; Cepacia lipase: 1 LU/ml; 3.5 kg soiled load present.

| Protease | Test cloth (A) R 460* | % F.M. | Test cloth (B) R 460* | % F.M. | AS10 ΔR 460* |
|---|---|---|---|---|---|
| Maxacal | 67.4 | 13.0 | 69.7 | 13.4 | 31.4 |
| BPN' | 76.6 | 8.7 | 78.1 | 8.6 | 21.2 |
| Kazusase | 77.1 | 8.0 | 79.0 | 8.1 | 31.3 |

EXAMPLE 5

Example 4 was repeated.

Conditions soiling: palm oil instead of groundnut oil; Amano-P lipase: 1 LU/ml; Gladioli lipase: 1 LU/ml.

The results were:

| Protease | Lipase | Test cloth (A) R 460* | % F.M. | Test cloth (B) R460* | % F.M. | AS10 ΔR 460* |
|---|---|---|---|---|---|---|
| — | Amano-P | 79.5 | 6.4 | 77.9 | 6.5 | 7.5 |
| Esperase | Amano-P | 74.6 | 9.3 | 74.4 | 10.0 | 29.6 |
| Savinase | Amano-P | 73.4 | 9.7 | 74.9 | 9.3 | 32.3 |
| Alcalase | Amano-P | 75.3 | 8.9 | 77.7 | 8.0 | 28.7 |
| Kazusase | Amano-P | 79.9 | 6.9 | 79.8 | 7.1 | 33.7 |
| — | gladioli | 79.1 | 7.3 | 75.2 | 7.3 | 9.6 |
| Esperase | gladioli | 74.2 | 10.8 | 74.6 | 9.4 | 26.2 |
| Savinase | gladioli | 77.7 | 8.5 | 73.5 | 9.9 | 34.5 |
| Alcalase | gladioli | 78.9 | 7.2 | 78.8 | 7.5 | 29.1 |
| Kazusase | gladioli | 77.6 | 8.1 | 78.3 | 7.7 | 32.4 |

We claim:

1. A detergent composition comprising from 1–50% by weight of one or more detergent surfactants, from 0.1–50 GU/mg of a protease and from 0.05–100 LU/mg of a lipase, wherein the protease has an isoelectric point of less than 10.0 and the lipase is a lipase which shows a positive immunological cross-reaction with the antibody of the lipase produced by *Chromobacter viscosum* var. lipolyticum NRRL B-3673.

2. A composition according to claim 1, wherein the protease has an isoelectric point of less than 9.

3. A composition according to claim 1, wherein the protease has an isoelectric point of 7.4.

4. A composition according to claim 1, wherein the lipase is selected from the group consisting of the lipases producible by *Pseudomonas fluorescens, Pseudomonas fragi, Pseudomonas nitroreducens* var. lipolyticum, *Psuedomonas cepacia, Pseudomonas gladioli* and *Chromobacter viscosum.*

* * * * *